United States Patent [19]

Dietrich et al.

[11] Patent Number: 4,881,499

[45] Date of Patent: Nov. 21, 1989

[54] HYDRAULIC PLAY COMPENSATING ELEMENT

[75] Inventors: Markus Dietrich, Fellbach-Oeffigen; Frank Berger, Leutenbach, both of Fed. Rep. of Germany

[73] Assignee: Mercedes-Benz AG, Stuttgart, Fed. Rep. of Germany

[21] Appl. No.: 296,599

[22] Filed: Jan. 13, 1989

[30] Foreign Application Priority Data

Jan. 15, 1988 [DE] Fed. Rep. of Germany ..... 3800945

[51] Int. Cl.[4] ..... F01L 1/24; F01L 13/06

[52] U.S. Cl. ..... 123/90.52; 123/90.55

[58] Field of Search ..... 123/90.52, 90.53, 90.55, 123/90.57

[56] References Cited

U.S. PATENT DOCUMENTS

| | | | |
|---|---|---|---|
| 3,406,668 | 10/1968 | Donnelly et al. | 123/90.55 |
| 4,164,917 | 8/1979 | Glasson | 123/90.55 |
| 4,254,749 | 3/1981 | Krieg et al. | 123/90.55 |
| 4,438,739 | 3/1984 | Arai et al. | 123/90.55 |
| 4,462,364 | 7/1984 | Kodama | 123/90.55 |
| 4,475,490 | 10/1984 | Oono et al. | 123/90.52 |
| 4,535,734 | 8/1985 | Kodama et al. | 123/90.55 |

FOREIGN PATENT DOCUMENTS 2606464 8/1976 Fed. Rep. of Germany .

*Primary Examiner*—Charles J. Myhre
*Assistant Examiner*—Weilun Lo
*Attorney, Agent, or Firm*—Barnes & Thornburg

[57] ABSTRACT

A hydraulic play compensating element adapted to be positioned in the valve train of an internal-combustion engine is described which comprises a cylinder part closes at one end and a piston part slidable longitudinally in the latter. The piston part contains a supply chamber which is pressurized by lubricating oil from the lubricating oil circuit and which is separated from a pressure chamber by a connecting duct controlled by a valve. In order to switch off the play compensating function of the play compensating element during engine braking service, a shut-off valve is provided in the supply chamber for closing or opening the connecting duct as a function of the lubricating oil pressure in the supply chamber.

8 Claims, 1 Drawing Sheet

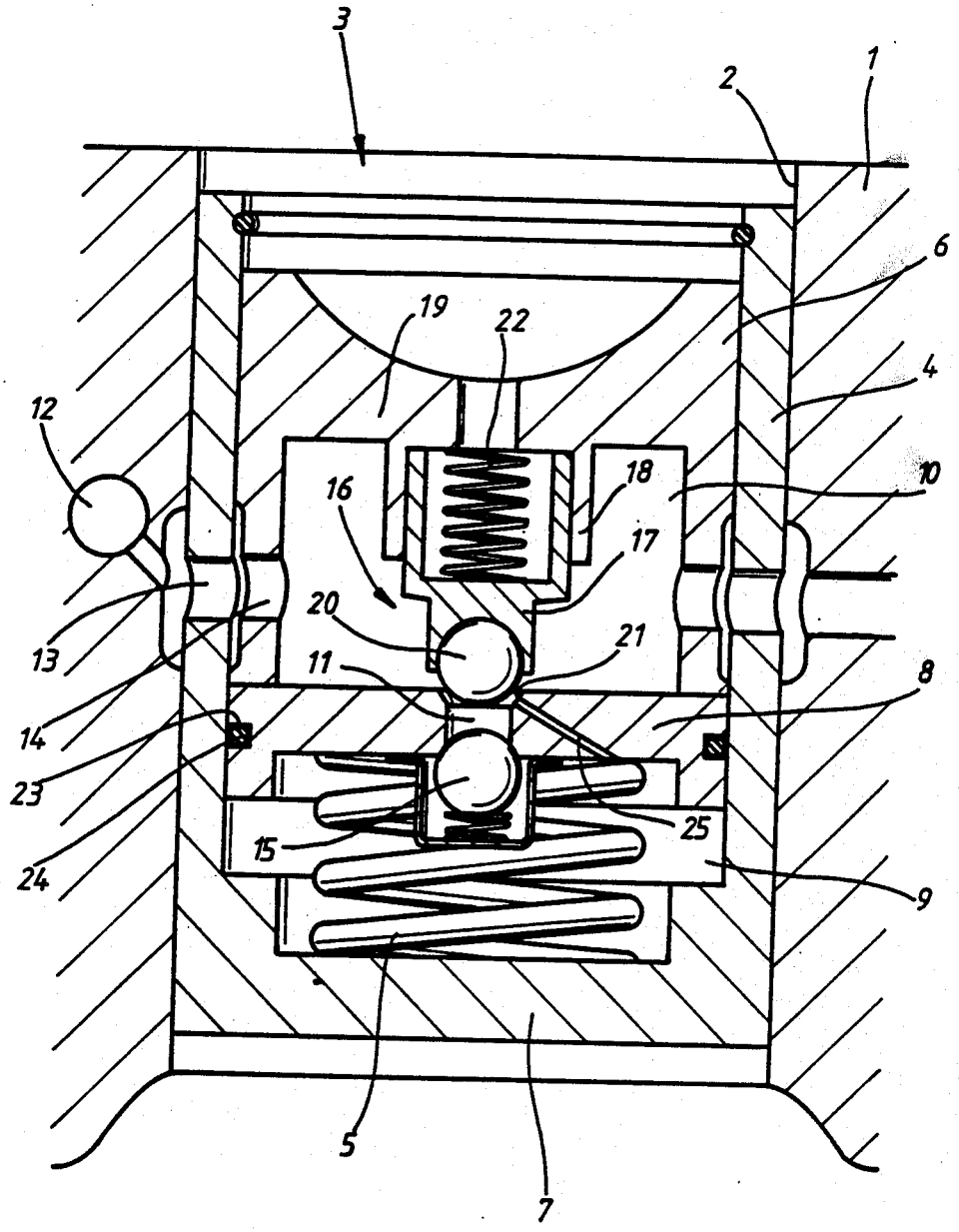
3
2
1
6
19
22
4
12
18
10
16
17
20
21
13
11
8
14
23
25
15
24
9
5
7

HYDRAULIC PLAY COMPENSATING ELEMENT

BACKGROUND AND SUMMARY OF THE INVENTION

The present invention generally relates to a hydraulic play compensating element for a valve train of an internal-combustion engine, and more particularly to a play compensation element adapted to be rendered inoperative as a function of the operating parameters of the internal combustion engine.

Hydraulic play compensating elements are known, such as disclosed by DE-PS 2,606,464, wherein an accidental readjustment of the compensating element is intended to be prevented by throttle gaps and inlet ducts in the oil circuit of the element upstream of the supply chamber.

However, it is impossible to interrupt the readjustment of the above-noted hydraulic play compensating element in a controlled way in response to specific operating conditions of the internal-combustion engine. Engine braking service is one such operating condition, for example. The exhaust gases which accumulate in the exhaust pipe upstream of the closed exhaust flap generate a counterforce on the valve springs through the outlet valves, which can become so great that a brief dynamic opening of the outlet valves can occur. The compensating element within the valve train is relieved by this means and readjusts. This has the disadvantage that the outlet valves no longer close in service under load.

Accordingly, it is an object of the invention to provide a hydraulic play compensating element in which the readjustment function can be interrupted in a controlled way.

This object is achieved according to the present invention by providing a hydraulic play compensating element comprising a cylinder part closed at one end, a hollow piston part slidable axially in the cylinder part and having a supply chamber adapted to be pressurized by lubricating oil pressure of the internal combustion engine. A pressure chamber, enclosed by the hollow piston part and the cylinder part is included for providing play compensation for the valve train of the internal combustion engine. A compression spring is also included for biasing the cylinder part and the piston part in opposite directions. A connecting duct connects the pressure chamber and the supply chamber, such that a spring biased closure element for opening and closing the connecting duct, operates independently of a further controlled shut-off valve for opening and closing the connecting duct of the closure element.

Due to the provision of the further controlled shut-off valve in the connecting duct, the readjustment function of the play compensating element can be interrupted arbitrarily in an advantageous manner.

Because an interruption of the readjustment function is generally desired only in specific operating modes of the internal-combustion engine, it is convenient if, according to the one embodiment of the present invention, the shut-off valve of the present invention is controlled as a function of operating parameters of the internal-combustion engine.

In accordance with advantageous features of preferred embodiments of the present invention, the lubricating oil from the lubricating oil circuit, which is provided as pressurized fluid for the play compensation, ensures a simple mode of control of the shut-off valve when the operation of the shut-off valve is actuated by the lubricating oil as a function of the oil pressure.

In order to obtain a compensating element of simple construction, it is advantageous, according to certain preferred embodiments of the present invention, to arrange the shut-off valve in the supply chamber of the piston part.

A simple structural configuration is obtained according to certain preferred embodiments of the present invention by constructing the shut-off valve as a stepped piston axially slidable at least in a direction counter to a return spring positioned at a wall of the piston part opposite the connecting duct and providing the stepped piston with a closure element which cooperates with a valve seat surface positioned in a region of the orifice of the connecting duct in the supply chamber.

In that a reliable interruption of the readjustment function of the play compensation element may be prejudiced by an overflow of leakage oil from the pressure chamber to the supply chamber or vice versa, through the ring gap between piston part and cylinder part, for example, in accordance with preferred embodiments of the present invention the ring gap is made particularly small, or alternatively it is bridged by a ring seal.

According to further preferred embodiments of the present invention, a capillary overflow bore is provided between pressure chamber and supply chamber to compensate for thermal expansion of the lubricating oil cushion in the pressure chamber and thermal longitudinal expansions of the valve train.

A discharge of oil from the supply chamber into the pressure chamber is possible through the overflow bore. The minimal readjustment movement of the piston part caused by this is undesirable when the readjustment function is switched off. For these reasons the orifice of the overflow bore is arranged, in accordance with certain preferred embodiments of the present invention, in the region of the valve seat surface of the shut-off valve. When the readjustment function is switched off, the shut-off valve closes the connecting duct and the overflow bore simultaneously.

Other objects, advantages and novel features of the present invention will become apparent from the following detailed description of the invention when considered in conjunction with the accompanying drawing.

BRIEF DESCRIPTION OF THE DRAWING

The single drawing FIGURE is a schematic sectional side view of a hydraulic play compensating element constructed according to a preferred embodiment of the present invention.

DETAILED DESCRIPTION OF THE DRAWING

A play compensating element, generally indicated by reference numeral 3, is inserted slidably in the longitudinal direction of the bore in a housing bore 2 of an engine housing 1 of an internal-combustion engine, not further shown. The play compensating element 3 comprises a cylinder part 4, in which a piston part 6 is retained slidably between a valve tappet or valve stem, not shown, and a compression spring 5. The compression spring 5 is braced against the base part 7 of the cylinder part 4 and against an end face wall 8 of the piston part 6, so that cylinder part and piston part are pretensioned in opposite movement directions, so that the cylinder part 4 is in contact without play by its base part 7 with a control cam, not shown, on the one hand, and the piston part with the tappet or stem of the breather valve on the other hand.

The piston part 6 encloses with the cylinder part 4 a pressure chamber 9 which is filled from a supply chamber 10 constructed in the piston part 6 with lubricating oil which is fed through a connecting duct 11. The supply chamber 10 is permanently stressed or pressurized by the lubricating oil circuit of the internal-combustion engine with lubricating oil which passes through an inlet duct 12 branched from the lubricating oil circuit, and corresponding inlet bores 13 and 14 in the cylinder part 4 and piston part 6, into the supply chamber 10.

In order to prevent a return flow of lubricating oil from the pressure chamber 9 into the supply chamber 10, the connecting duct 11 is closed by a spring-loaded closure element 15 aranged on the pressure chamber side. When any play appears in the valve train, the piston part 6 is slid towards the tapped articulation by the compression spring 5 located in the pressure chamber 9. Due to the pressure drop which then occurs in the pressure chamber 9, the closure element 15 is opened by the pressure of the lubricating oil in the supply chamber 10 and lubricating oil is fed into the pressure chamber.

This topping up of the play compensation element 3, which serves to compensate play, is undesirable during engine braking service of the internal-combustion engine, for example.

According to the invention a shut-off valve 16 is therefore provided in the supply chamber, from which the readjustment function of the play compensating element 3 can be switched off.

Theshut-off valve 16 comprises a stepped piston 17, the enlarged piston section of which is guided for longitudinal sliding in a guide sleeve 18. The guide sleeve 18 is fitted to a piston wall 19 opposite the connecting duct 11 and projects into the supply chamber 10. A closure member 20, which cooperates with a valve seat 21 constructed in the region of the orifice of the connecting duct 11 into the supply chamber, is provided on the stepped part of the piston 17.

The shut-off valve 16 is controlled as a function of the lubricating oil pressure in the supply chamber 10. During normal service of the internal-combustion engine the shut-off valve 16 occupies the open position, that is to say the stepped piston 17 is controlled by the lubricating oil pressure, counter to the effect of a return spring 22 braced against the piston 17 and the piston wall 18, into an upper limit position in which the closure member 20 is lifted from the seat surface 21 so that compensation of play can occur. The readjustment function or play compensating function is switched off by reducing the lubricating oil pressure in the supply chamber 10. Due to the absence of counterpressure, the stepped piston 17 is slid by the return spring 22 towards the connecting duct 11 until the closure element 20 rests upon the seat surface 21.

The control of the lubricating oil pressure may occur by an electromagnetically controlled shut-off valve arranged in the inlet duct 12, for example. The valve is open during normal service of the internal-combustion engine, so that the lubricating oil pressure is applied in the supply chamber 10. If it is required to switch off the readjustment function of the play compensating element 3, for engine braking service for example, then a corresponding voltage signal is applied to the shut-off valve, whereby the inlet duct 12 is separated from the lubricating oil circuit and the supply chamber 10 therefore becomes pressureless. This voltage signal may be derived from a position sensor located at the exhaust sensor flap in the exhaust pipe of the internal-combustion engine, for example. It is possible for the shut-off valve to be controlled by other service parameter signals of the internal-combustion engine.

In order to prevent leakage oil losses between pressure chamber 9 and supply chamber 10, the piston part 6 is guided as a close fit in the cylinder part 4. Instead of a close fit, the piston part 6 may also be guided fluid-tightly in the cylinder part 4 by a ring seal 24 inserted in a ring groove 23 at the piston circumference between the inlet bore 14 and the piston wall 8. To compensate the length of the valve train (floating state of the cylinder part 4) due to temperature effects, the pressure chamber 9 is connected to the supply chamber 10 by a capillary overflow bore 25, the orifice of which is located within the seat surface 21.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Hydraulic play compensating element for a valve train of an internal combustion engine comprising:

(a) a cylinder part closed at one end;

(b) a hollow piston part slidable axially in the cylinder part and having a supply chamber adapted to be pressurized by lubricating oil pressure of the internal combustion engine;

(c) a pressure chamber, enclosed by the hollow piston part and the cylinder part, for providing play compensation for the valve train of the internal combustion engine;

(d) a compression spring for biasing the cylinder part and the piston part in opposite directions;

(e) a connecting duct for connecting the pressure chamber and the supply chamber;

(f) a spring biased closure element for opening and closing the connecting duct; and (g) a shut-off valve for opening and closing the connecting duct independently of the closure element.

2. Hydraulic play compensating element according to claim 1, wherein the shut-off valve is controlled as a function of operating parameters of the internal-combustion engine.

3. Hydraulic play compensating element according to claim 2, wherein the shut-off valve is controlled as a function of the lubricating oil pressure in the supply chamber.

4. Hydraulic play compensating element according to claim 3, wherein the shut-off valve is arranged in the supply chamber.

5. Hydraulic play compensating element according to claim 4, wherein the shut-off valve comprises a stepped piston at least slidable in an axial direction counter to a return spring positioned at a piston wall of the piston part opposite the connecting duct, the stepped piston having a closure member which cooperates with a valve seat surface provided in the region of an orifice of the connecting duct in the supply chamber.

6. Hydraulic play compensating element according to claim 5, wherein a ring seal, inserted in a groove, is arranged at an outer circumference of the piston part in a region between a connecting bore for the connection of the supply chamber to a lubricating oil circuit of the internal combustion engine and a pressure chamber side end wall of the piston part.

7. Hydraulic play compensating element according to claim 6, wherein a capillary overflow bore is arranged in the end wall of the piston part between supply chamber and pressure chamber.

8. Hydraulic play compensating element according to claim 7, wherein the overflow bore leads into the region of the valve seat surface.

* * * * *

UNITED STATES PATENT AND TRADEMARK OFFICE

CERTIFICATE OF CORRECTION

PATENT NO. : 4,881,499

DATED : Nov. 21, 1989

INVENTOR(S) : Markus Dietrich, et al.

It is certified that error appears in the above-identified patent and that said Letters Patent is hereby corrected as shown below:

On the title page, should be corrected to read

--[73] Assignee: Daimler-Benz Aktiengesellschaft--.

Signed and Sealed this

Eleventh Day of June, 1991

*Attest:*

HARRY F. MANBECK, JR.

*Attesting Officer*

*Commissioner of Patents and Trademarks*